United States Patent [19]

Marcil

[11] 4,005,866

[45] Feb. 1, 1977

[54] MAGNETIC GAME

[76] Inventor: Jean Pierre Marcil, 22 Mac Donald St., Maple Grove, Beauharnois, Quebec, Canada, J6N 1N9

[22] Filed: Sept. 15, 1975

[21] Appl. No.: 613,403

[52] U.S. Cl. ..... 273/131 A; 273/131 B; 273/131 KC

[51] Int. Cl.[2] ..... A63F 3/00

[58] Field of Search ..... 273/130, 131, 136, 134

[56] References Cited

UNITED STATES PATENTS

| | | | |
|---|---|---|---|
| 2,819,904 | 1/1958 | Nelson et al. | 273/131 AD UX |
| 3,680,865 | 8/1972 | Davis | 273/134 AE |
| 3,761,092 | 9/1973 | Shieff | 273/131 AD |

*Primary Examiner*—Delbert B. Lowe

[57] ABSTRACT

A magnetic skill game for two players where the magnetic properties of attraction, repulsion, or magnetic null are used as a means of secret guidance for the players in their attempt to capture each other's key-piece; consisting of a board made of a material that is not magnetic or ferro-magnetic except for at least one case which is ferro-magnetic and a set of pieces for each player which includes at least one piece which is not magnetic or ferro-magnetic and at least one piece that is ferro-magnetic; the latter being clearly identified as the key piece, and at least one piece that is magnetic (the polarity of the latter being opposite for the opposite player). The pieces of a player appear identical except for the ferro-magnetic piece identified as the key piece.

1 Claim, 4 Drawing Figures

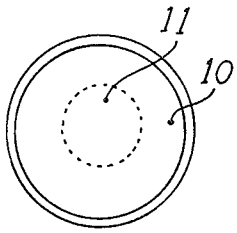
fig 1
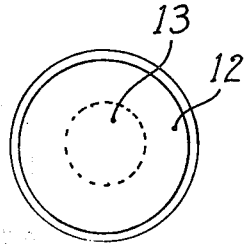
fig 2
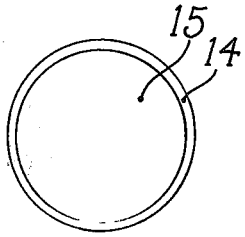
fig 3
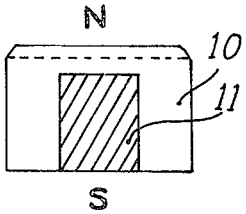
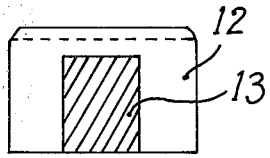
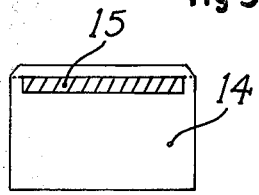
fig 4
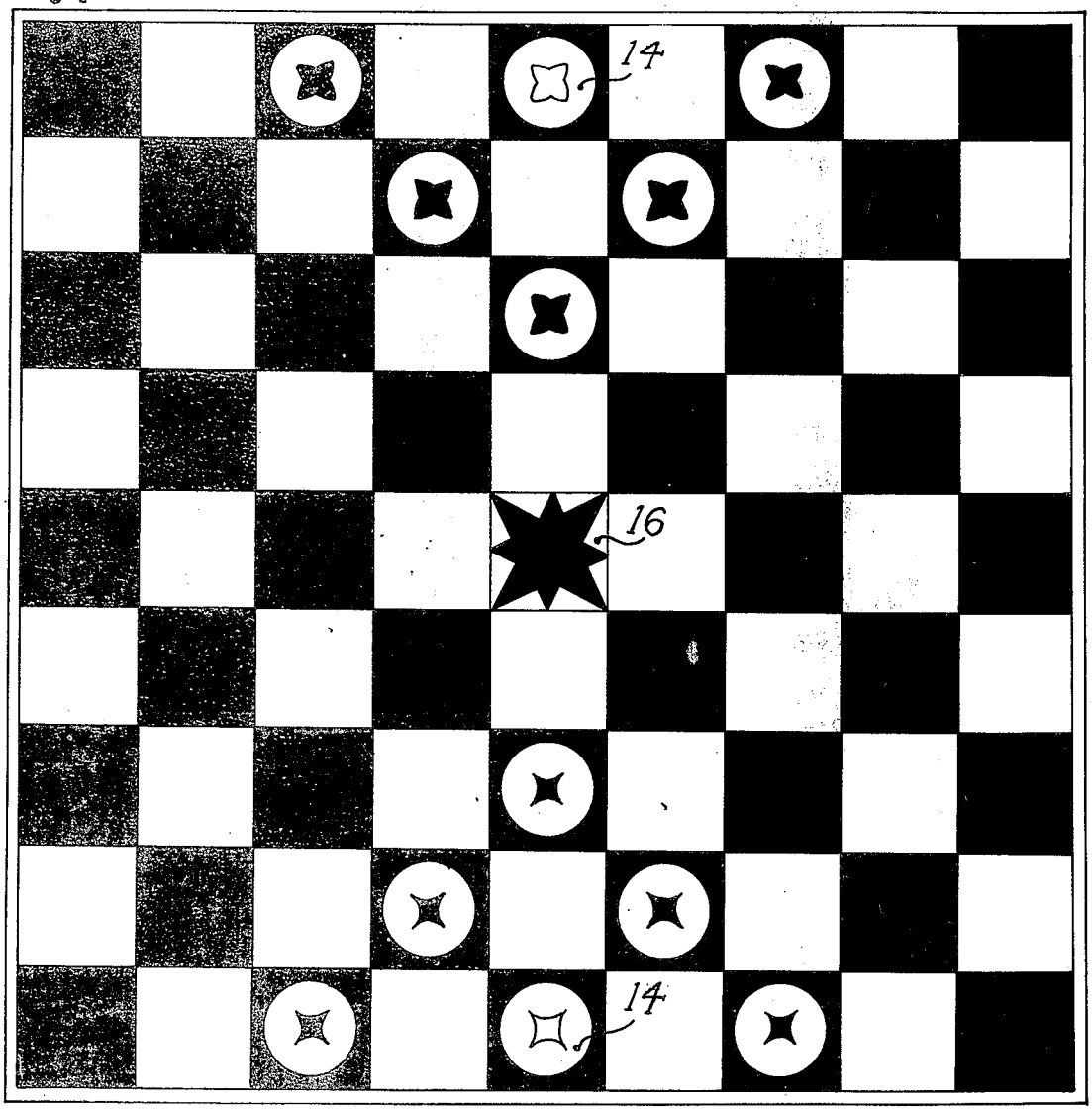

MAGNETIC GAME

BACKGROUND OF THE INVENTION

1. Field of the Invention

This invention relates to a skill game played on a board where two players are attempting to capture each other's key piece. Each player is handicapped by at least one secret traitor in his ranks. The game also provides means of verification to help discover traitors.

2. Description of Prior Art

In most previous games such as checkers and chess the pieces have a known and constant value and bluffing is impossible. This reduces the interest of the players.

SUMMARY OF INVENTION

In the present invention more interest is provided in the game by incorporating a means of deception consisting of at least one piece for each player who is actually a secret ally of the opponent. The true allegiance of the pieces can be magnetically verified by a player without the awareness of his adversary. This can be done by direct confrontation of two pieces, or by verification while passing over a specially designed case of the board.

According to a broad aspect this invention relates to a skill game including treacherous pieces. The game consists of a board and a set of pieces for each of the two players. The board itself is not magnetic or ferromagnetic except for at least one case which has a ferromagnetic plate called the verification case. Each player has at least one of each of the three types of pieces referred to as: key piece, true piece, and traitor.

A player loses the game when the enemy captures his key piece. The key piece is clearly identified and it carries a ferro-magnetic insert within. The true piece and the traitor are visually undistinguishable but the true piece is non-magnetic and non ferro-magnetic while the traitor type carriers a polarized magnet bar placed vertically within. The polarity of the traitor pieces is opposite for opposite players, so when two traitors are confronted they repulse. The traitor will be attracted when a player moves it over the verification case. This way only the player holding the piece is informed while the other player is unaware.

Note: the setting of the pieces should be as per FIG. 4, and the players should not know which pieces are traitors. To play: each player makes alternate moves one cast at a time on the dark cases only. The pieces can move in any direction while attempting to capture the key piece of the enemy.

A player can plan a much superior attack if he first verifies his pieces on the verification case. This way he can find who is the traitor in his ranks (as it will stick to the verification case). Knowing the traitor in his ranks he can use it to determine which piece of the enemy is actually his ally, since the two will repulse when confronted. The traitor cannot be used to capture the key piece of the enemy, but can capture any other enemy pieces. Note: a player should not leave a piece more than one turn on the verification case, as otherwise his opponent at his turn could remove and capture it; this way the opponent would also know the true identity of the piece being verified.

All pieces can attack (kill) except for the key piece which moves only defensively. The kill is similar to a chess pawn and not like checkers where a blank case is required behind the victim's case in order to make a kill where the attacker takes the place of the victim. The attacking player first holds his piece and touches the top of his opponent's piece. He then removes the latter and replaces it with his own. The victim is taken off the board and is kept by the attacker. If the two pieces involved were traitors the attacking player would have felt a slight repulsion.

When a player captures a piece which is his ally (enemy's traitor) he keeps this piece away from the board long enough so that his opponent could not remember which piece was used to capture it. If the enemy were to know which piece was used to discover this traitor it would mean that the enemy would also know who is his ally and would change his plan of attack.

A player can at his turn take one of his prisoners out and place it on top of his key man. (Note: The prisoners are the pieces captured during the game. If they cling together, they remain together and the key man can now kill just like a normal piece. If the two pieces do not stick one to another the prisoner is released to the enemy who can place it anywhere on his side of the board and the enemy enjoys one additional turn.

BRIEF DESCRIPTION OF DRAWINGS

A preferred embodiment of the present invention will now be described with reference to the accompanying drawings in which:

FIG. 1 is a top plan view and a cross section of a traitor type piece which has a polarized bar magnet inside.

FIG. 2 is a top plan view and a cross section of a true type piece which has a non-magnetic and non ferro-magnetic metal insert weight inside.

FIG. 3 is a top plan view and a cross section of a key type piece which has a ferro-magnetic insert within.

FIG. 4 is a top plan view of the board showing the pieces in position and showing the verification case 16 in the center of the board. The key pieces are identified by number 14.

DESCRIPTION OF PREFERRED EMBODIMENTS

Referring to the drawings and more particularly to FIG. 1 — there is shown a play piece of the traitor type 10 which is preferably cylindrical with a flat top and bottom and made of plastic with a polarized magnet bar 11 which is placed vertically closer to the bottom the piece, (Note: The polarized magnet bar is mounted in a manner that the magnet end is flush with the bottom of the piece) a gap is provided preferably between the top of the magnet and the actual top of the piece so that repulsion is not too strong when two traitors are confronted. The polarity of the traitor is opposite for the opposite player (if player X has N/S magnet polarity player Y should have S/N magnet polarity).

In FIG. 2 there is shown a true piece, which is cylindrical with flat top and bottom preferably made of molded plastic with an inert metal weight 13 (brass). The true piece could be without any metal insert if its weight could be kept the same as the weight of the traitor.

In FIG. 3 there is shown a key piece 14. This piece appears different than the true piece and the traitor piece. It is cylindrical with flat top and bottom 14 and has a small ferro-magnetic plate 15 close to its upper surface.

In FIG. 4 there is shown a board with an odd number of cases. The central case 16 is specially marked and has a small ferro-magnetic plate placed on top of the case, the remainder of the board is made of a non-magnetic and non-ferro magnetic material such as cardboard or plastic.

I claim:

1. A magnetic skill game for two players where the magnetic properties of attraction, repulsion, or magnetic null are used as a means of secret guidance for the players in their attempt to capture each other's pieces; consisting of a board made of a material that is not magnetic or ferro-magnetic except for at least one case which is magnetic and a set of pieces for each player which includes at least one piece which is not magnetic or ferro-magnetic and at least one piece that is magnetic; the latter being visually distinguishable from all other pieces, and at least one piece that is magnetic, the polarity of the latter being opposite for opposite players; the pieces of a player appearing identical except for the magnetic piece.

* * * * *